US006494037B2

(12) United States Patent
Oguma et al.

(10) Patent No.: US 6,494,037 B2
(45) Date of Patent: Dec. 17, 2002

(54) ENGINE EXHAUST PURIFICATION DEVICE

(75) Inventors: Hajime Oguma, Zama (JP); Ritsuo Sato, Yokohama (JP)

(73) Assignee: Nissan Motor Co., Ltd., Yokohama (JP)

( * ) Notice: Subject to any disclaimer, the term of this patent is extended or adjusted under 35 U.S.C. 154(b) by 0 days.

(21) Appl. No.: 09/784,335

(22) Filed: Feb. 16, 2001

(65) Prior Publication Data

US 2001/0022081 A1 Sep. 20, 2001

(30) Foreign Application Priority Data

Feb. 17, 2000 (JP) ..... 2000-039980
Feb. 14, 2001 (JP) ..... 2001-036287

(51) Int. Cl.[7] ..... F01N 3/00
(52) U.S. Cl. ..... 60/285; 60/276
(58) Field of Search ..... 60/274, 276, 277, 60/284, 285

(56) References Cited

U.S. PATENT DOCUMENTS 5,077,970 A * 1/1992 Hamburg ..... 60/274
5,207,056 A * 5/1993 Benninger ..... 60/285
5,606,855 A * 3/1997 Tomisawa ..... 60/285
5,609,023 A * 3/1997 Katoh et al. ..... 60/276
5,678,402 A * 10/1997 Kitagawa et al. ..... 60/285
5,842,340 A 12/1998 Bush et al.
5,845,486 A * 12/1998 Yamashita et al. ..... 60/284
5,881,552 A * 3/1999 Iwata et al. ..... 60/284
5,901,552 A 5/1999 Schnaibel et al.
5,956,941 A * 9/1999 Cullen et al. ..... 60/274
6,185,933 B1 * 2/2001 Tsuzuki et al. ..... 60/285
6,226,982 B1 * 5/2001 Poggio et al. ..... 60/276
6,289,673 B1 * 9/2001 Tayama et al. ..... 60/285

FOREIGN PATENT DOCUMENTS

JP 9-228873 9/1997

OTHER PUBLICATIONS

U.S. patent application Ser. No. 09/418,255, Tayama et al., filed Oct. 15, 1999.

* cited by examiner

*Primary Examiner*—Thomas Denion
*Assistant Examiner*—Tu M. Nguyen
(74) *Attorney, Agent, or Firm*—Foley & Lardner

(57) ABSTRACT

A controller controls an air-fuel ratio of an engine to maintain the oxygen storage amount of a catalyst provided in an exhaust passage at a predetermined amount. At this time, the controller first estimates the initial value of the oxygen storage amount based on the catalyst temperature on engine startup, and then computes an oxygen storage characteristic using this estimated initial value. In this way, the oxygen storage amount can be precisely computed even immediately after engine startup, and the conversion efficiency of the catalyst is maintained at a high level.

6 Claims, 14 Drawing Sheets

ENGINE EXHAUST PURIFICATION DEVICE

FIELD OF THE INVENTION

The present invention relates to an engine exhaust purification device provided with a catalyst

BACKGROUND OF THE INVENTION

JP-A-H9-228873 published by the Japanese Patent Office in 1997 discloses a technique wherein an oxygen amount stored in a three-way catalyst (hereafter, "oxygen storage amount") is computed based on an engine intake air amount and an air-fuel ratio of an exhaust flowing into the catalyst, and engine air-fuel ratio control is performed so that the oxygen storage amount of the catalyst is constant.

To maintain the NOx (nitrogen oxides), CO and HC (hydrocarbon) conversion efficiency of the three-way catalyst at a maximum, the catalyst atmosphere must be maintained at the stoichiometric air-fuel ratio. By maintaining the oxygen storage amount of the catalyst constant, oxygen in the exhaust is stored in the catalyst when the air-fuel ratio of the exhaust flowing into the catalyst shifts to lean, and oxygen stored in the catalyst is released when the air-fuel ratio of the exhaust flowing into the catalyst shifts to rich, so the catalyst atmosphere can be maintained at the stoichiometric air-fuel ratio.

In an exhaust purification device which performs this control, the conversion efficiency of the catalyst depends on the oxygen storage amount of the catalyst. Therefore, to control the oxygen storage amount to be constant and maintain the conversion efficiency of the catalyst at a high level, the oxygen storage amount must be precisely computed.

SUMMARY OF THE INVENTION

However, in the prior art computational method, the oxygen amount already stored on engine startup was not considered, and it was difficult to precisely compute the oxygen storage amount of the catalyst.

It is therefore an object of this invention to further increase the precision of computing the oxygen storage amount in the aforesaid purification device technique. In particular, it is an object of the invention to increase computational precision immediately after engine startup, and to maintain the conversion efficiency of the catalyst at a high level even immediately after engine startup.

In order to achieve above object, this invention provides an exhaust purification device for an engine, comprising a catalyst provided in an exhaust passage of the engine, a first sensor which detects the characteristics of the exhaust flowing into the catalyst, and a microprocessor. The microprocessor is programmed to estimate an oxygen storage amount of the catalyst on engine startup based on the temperature of the catalyst on engine startup, compute the oxygen storage amount of the catalyst based on the detected exhaust characteristics, using the oxygen storage amount on engine startup as an initial value, and control the air fuel ratio of the engine based on the computed oxygen storage amount so that the oxygen storage amount of the catalyst is a target value.

According to an aspect of this invention, this invention provides a method of estimating an oxygen storage amount of a catalyst provided in an exhaust passage of an engine. The method comprises estimating the oxygen storage amount of the catalyst on engine startup based on the temperature of the catalyst on engine startup, and computing the oxygen storage amount of the catalyst based on the characteristics of the exhaust flowing into the catalyst, using the oxygen storage amount on engine startup as an initial value.

The details as well as other features and advantages of this invention are set forth in the remainder of the specification and are shown in the accompanying drawings.

Strictly speaking, noble metals adsorb oxygen in the molecular state, and oxygen storage materials absorb oxygen as compounds, but in the following description, adsorption and absorption will be collectively referred to as storage.

Further, the expression "the exhaust air-fuel ratio is rich" means that the oxygen concentration in the exhaust is lower than the oxygen concentration in the exhaust when the engine is running at the stoichiometric air-fuel ratio, and the expression "the exhaust air-fuel ratio is lean" means that the oxygen concentration in the exhaust is higher than the oxygen concentration when the engine is running at the stoichiometric air-fuel ratio. The expression "the exhaust air-fuel ratio is stoichiometric" means that the oxygen concentration in the exhaust is equal to the oxygen concentration of the exhaust when the engine is running at the stoichiometric air-fuel ratio.

DESCRIPTION OF THE PREFERRED EMBODIMENTS

Figure 1:
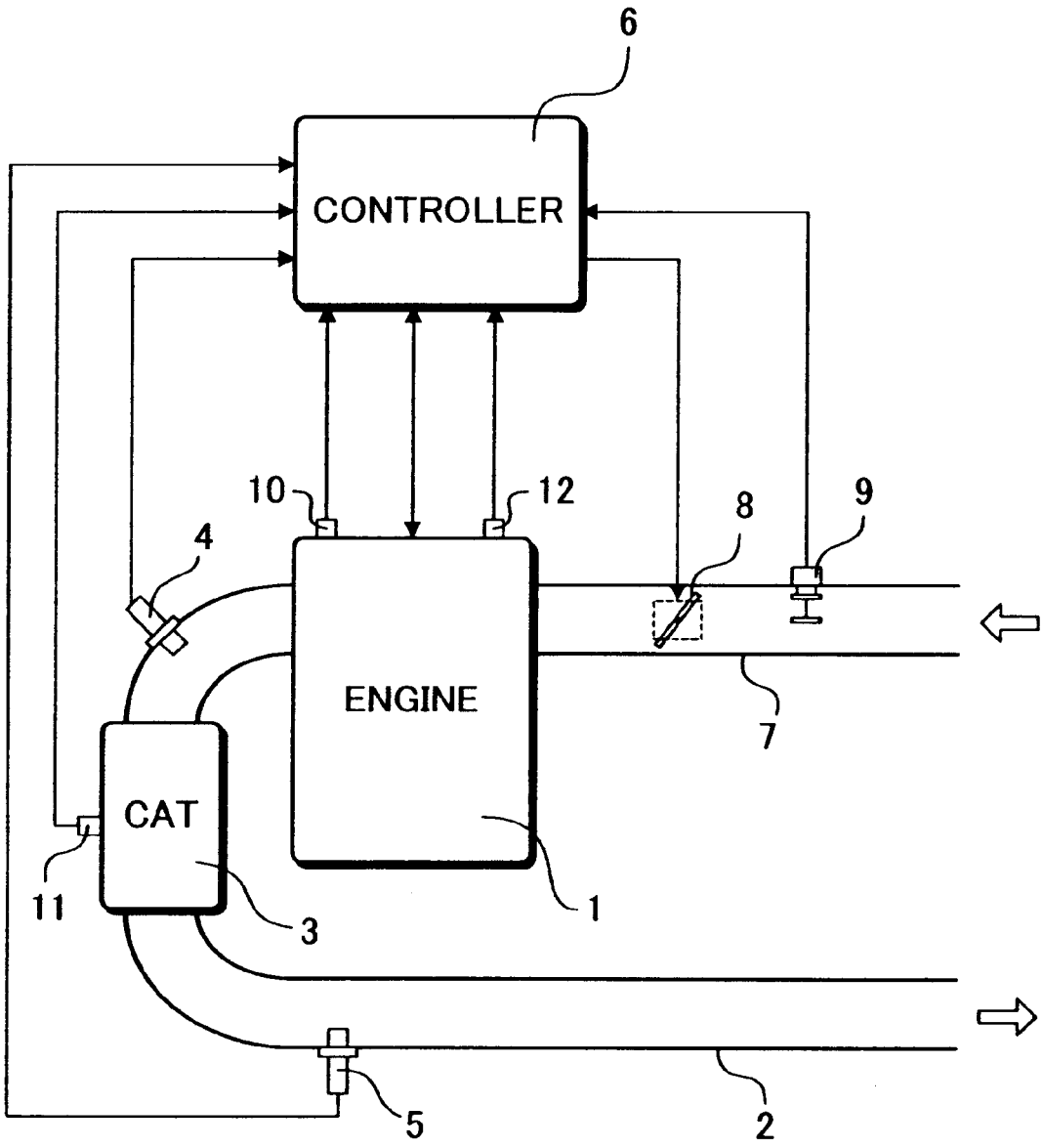
FIG. 1 is a schematic diagram of an exhaust purification device according to this invention.

Referring to FIG. 1 of the drawings, an exhaust passage 2 of an engine 1 is provided with a catalyst 3, front wide range air-fuel ratio sensor 4 (hereafter referred to as front A/F sensor), rear oxygen sensor 5 and controller 6.

A throttle valve 8, and an air flow meter sensor 9 which detects the intake air amount adjusted by the throttle valve 8, are provided in an intake passage 7 of the engine 1. In addition, a crank angle sensor 12 which detects the engine rotation speed of the engine 1 is provided.

The catalyst 3 is a catalyst having a three-way catalyst function. The catalyst 3 purifies NOx, HC and CO with maximum efficiency when the catalyst atmosphere is at the stoichiometric air-fuel ratio. The catalyst carrier of the catalyst 3 is coated with an oxygen storage material such as cerium oxide, and the catalyst 3 has the function of storing or releasing oxygen according to the air-fuel ratio of the inflowing exhaust (referred to hereafter as oxygen storage function).

Here, the oxygen storage amount of the catalyst 3 may be partitioned into a high speed component HO2 which is stored and released by a noble metal in the catalyst 3 (Pt, Rh, Pd), and a low speed component LO2 which is stored and released by the oxygen storage material in the catalyst 3. The low speed component LO2 represents the storage and release of a larger amount of oxygen than the high speed component HO2, but its storage/release rate is slower than that of the high speed component HO2.

Further, this high speed component HO2 and low speed component LO2 have characteristics as follows:

When oxygen is stored, oxygen is stored preferentially as the high speed component HO2, and begins to be stored as the low speed component LO2 when the high speed component HO2 has reached a maximum capacity HO2MAX and can no longer be stored.

When oxygen is released, and the ratio of the low speed component LO2 to the high speed component HO2 (LO2/HO2) is less than a predetermined value, i.e. when the high speed component is relatively large, oxygen is preferentially released from the high speed component HO2, and when the ratio of the low speed component LO2 to the high speed component HO2 is larger than the predetermined value, oxygen is released from both the high speed component HO2 and low speed component LO2 so that the ratio of the low speed component LO2 to the high speed component HO2 does not vary.

Figure 2:
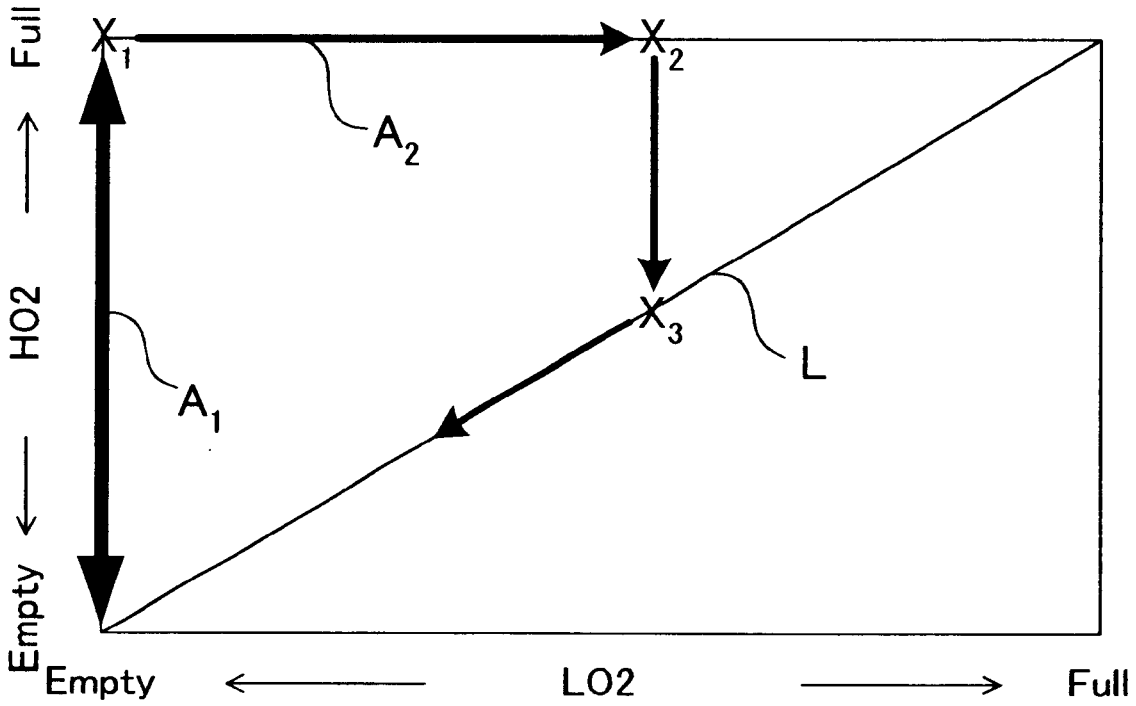
FIG. 2 is a diagram showing the oxygen storage/release characteristics of a catalyst.

FIG. 2 shows the oxygen storage/release characteristics of the catalyst. The vertical axis shows the high speed component HO2 (oxygen amount stored in the noble metal) and the horizontal axis shows the low speed component LO2 (oxygen amount stored in the oxygen storage material).

In the normal running condition, the low speed component LO2 is almost zero and only the high speed component HO2 varies according to the air-fuel ratio of the exhaust flowing into the catalyst as shown as the arrow $A_1$ in the Figure. The high speed component HO2 is controlled, for example, to be half of its maximum capacity.

However, when the engine fuel cut has performed or when the engine has restarted from the warmed-up state (hot restart), the high speed component HO2 has reached its maximum capacity and oxygen is stored as the low speed component LO2 (arrow $A_2$ in FIG. 2). The oxygen storage amount varies from the point $X_1$ to the point $X_2$.

When oxygen is released from the point $X_2$, oxygen is preferentially released from the high speed component HO2. When the ratio of the low speed component LO2 to the high speed component HO2 reaches the predetermined value ($X_3$ in FIG. 2), oxygen is released from both the high speed component HO2 and low speed component LO2 so that the ratio of the low speed component LO2 to the high speed component HO2 does not vary, i.e., oxygen is released while moving on a straight line L shown in the Figure. Here, on the line L, the low speed component is from 5 to 15, but preferably approximately 10, relative to the high speed component 1.

Returning to FIG. 1, the front A/F sensor 4 provided upstream of the catalyst 3 outputs a voltage according to the air-fuel ratio of the exhaust flowing into the catalyst 3. The rear oxygen sensor 5 provided downstream of the catalyst 3 detects whether the exhaust air-fuel ratio downstream of the catalyst 3 is rich or lean with the stoichiometric air-fuel ratio as a threshold value. Here, an economical oxygen sensor was provided downstream of the catalyst 3, but an A/F sensor which can detect the air fuel ratio continuously can be provided instead. The catalyst temperature sensor 11 which detects the internal temperature of the catalyst is attached to the catalyst 3.

The cooling water temperature sensor 10 which detects the cooling water temperature TWN is fitted to the engine 1. The detected cooling water temperature is used for determining the running state of the engine 1.

The controller 6 a microprocessor, RAM, ROM and I/O interface, and it computes the oxygen storage amount of the catalyst 3 (high speed component HO2 and low speed component LO2) based on the output of the air flow meter sensor 9, front A/F sensor 4 and cooling water temperature sensor 10. At this time, the oxygen storage amount is computed using an initial value HO2INT of the oxygen storage amount which was previously estimated based on the catalyst temperature TCATINT on engine startup (described later).

When the high speed component HO2 of the computed oxygen storage amount is greater than a predetermined amount (e.g., half the maximum capacity HO2MAX of the high speed component), the controller 6 makes the air fuel ratio of the engine 1 rich, makes the air-fuel ratio of the exhaust flowing into the catalyst 3 rich, and decreases the high speed component HO2. Conversely, when it is less than the predetermined amount, the controller 6 makes the air fuel ratio of the engine 1 lean, makes the air-fuel ratio of the exhaust flowing into the catalyst 3 lean, increases the high speed component HO2, and maintains the high speed component HO2 of the oxygen storage amount constant.

A discrepancy may arise between the computed oxygen storage amount and real oxygen storage amount due to computational error, so the controller 6 resets the computational value of the oxygen storage amount with a predetermined timing based on the air-fuel ratio of the exhaust downstream of the catalyst 3, and corrects this discrepancy from the real oxygen storage amount.

Specifically, when it is determined that the air-fuel ratio downstream of the catalyst 3 is lean based on the output of the rear oxygen sensor 5, it is determined that at least the high speed component HO2 is maximum, and the high speed component HO2 is reset to maximum capacity. When it is determined by the rear oxygen sensor 5 that the air fuel ratio downstream of the catalyst 3 is rich, oxygen is no longer being released not only from the high speed component HO2 but also from the low speed component LO2, so the high speed component HO2 and high speed component LO2 are reset to minimum capacity.

Next, the control performed by the controller 6 will be described.

First, the computation of the oxygen storage amount will be described, followed by resetting of the computational value of the oxygen storage amount, and air-fuel ratio control of the engine 1 based on the oxygen storage amount.

Figure 3:
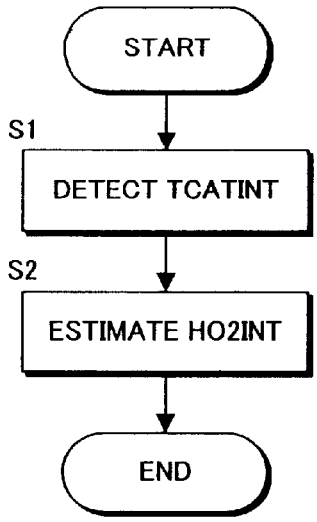
FIG. 3 is a flowchart showing a routine for estimating an initial value of the high speed component of the oxygen storage amount of the catalyst.

When the engine 1 is started, the initial value the HO2INT of the high speed component of the oxygen storage amount is first estimated by the routine shown in FIG. 3 to increase the computational precision of the oxygen storage amount immediately after startup of the engine 1. Subsequently, the high speed component HO2 and low speed component LO2 of the oxygen storage amount are computed by the routine shown in FIG. 5 using this initial value HO2INT.

Figure 4:
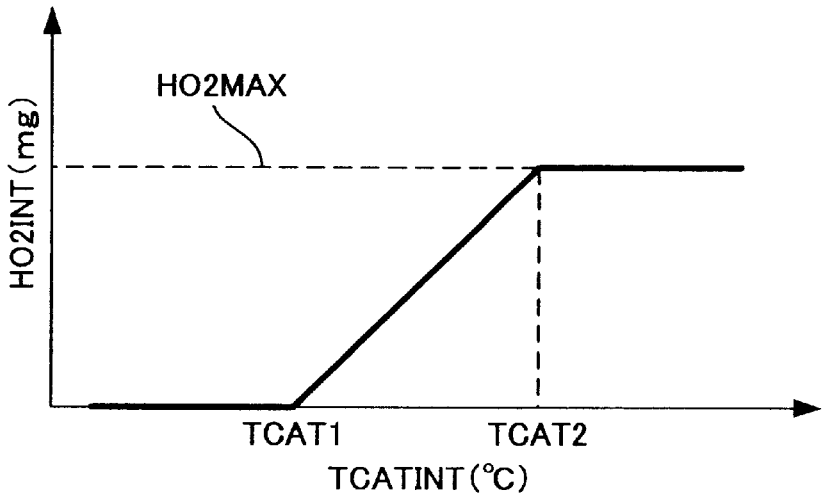
FIG. 4 is a table used when the initial value of the high speed component of the oxygen storage amount is estimated from the catalyst temperature.

In the routine shown in FIG. 3, the initial value HO2INT of the high speed component is estimated by looking up a table shown in FIG. 4 based on the catalyst temperature TCATINT on engine startup detected by the catalyst temperature sensor 11 (steps S1, S2).

If the catalyst temperature TCATINT on engine startup is low, the catalyst 3 cannot store oxygen, so the initial value HO2INT of the high speed component HO2 is estimated to be zero. Further, when the catalyst temperature TCATINT on engine startup is above a predetermined temperature TCAT1 (from 200° C. to 250° C., e.g., 200° C.), the oxygen amount stored by the catalyst 3 increases the higher the temperature, so the initial value HO2INT of the estimated high speed component also increases. However, the maximum capacity HO2MAX of the high speed component is not exceeded, so above a predetermined temperature TCAT2 (e.g., 300° C.), the initial value of the high speed component is estimated as the maximum capacity HO2MAX. It should be noted that the table shown in FIG. 4 is only an example, and a table comprising more detailed characteristics or a simplified table may also be used.

Figure 5:
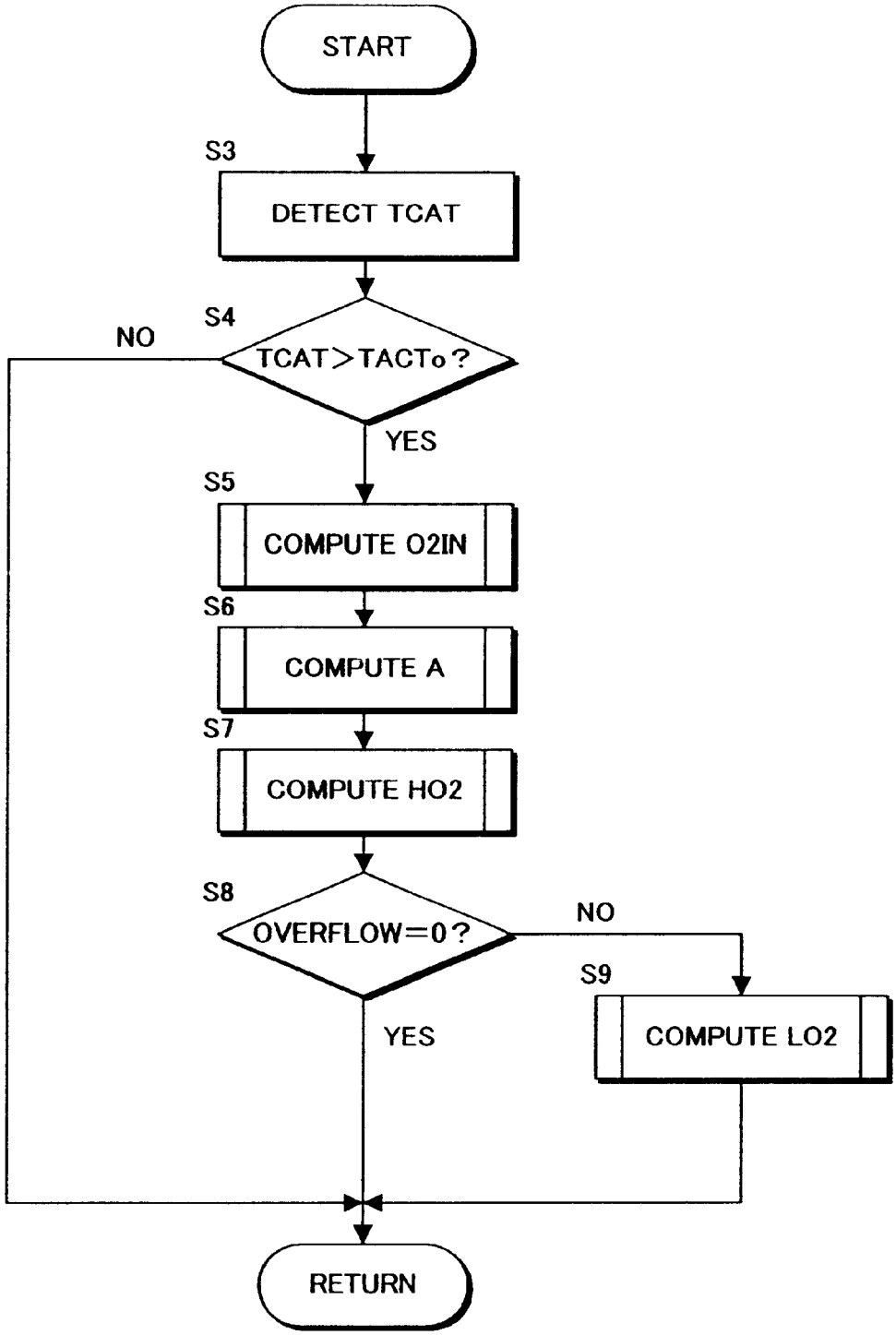
FIG. 5 is a flowchart showing a routine for computing an oxygen storage amount of the catalyst.

Once the initial value HO2INT of the high speed component HO2 of the oxygen storage amount has been estimated, the routine shown in FIG. 5 is executed at a predetermined interval, and the high speed component HO2 and low speed component LO2 are computed.

According to this, firstly in a step S3, the temperature TCAT of the catalyst 3 is detected based on the output of the catalyst temperature sensor 11. In a step S4, it is determined whether or not the catalyst 3 has been activated by comparing the detected catalyst temperature TCAT and a catalyst activation temperature TACTo.

When the catalyst activation temperature TACTo (e.g., 300° C.) has been reached, it is determined that the catalyst 3 is active, and the routine proceeds to a step S5 and subsequent steps to compute the oxygen storage amount of the catalyst 3. When the catalyst activation temperature TACTo has not been reached, it is determined that the catalyst 3 is not active, the catalyst 3 does not store or release oxygen, and the routine is terminated.

Figure 6:
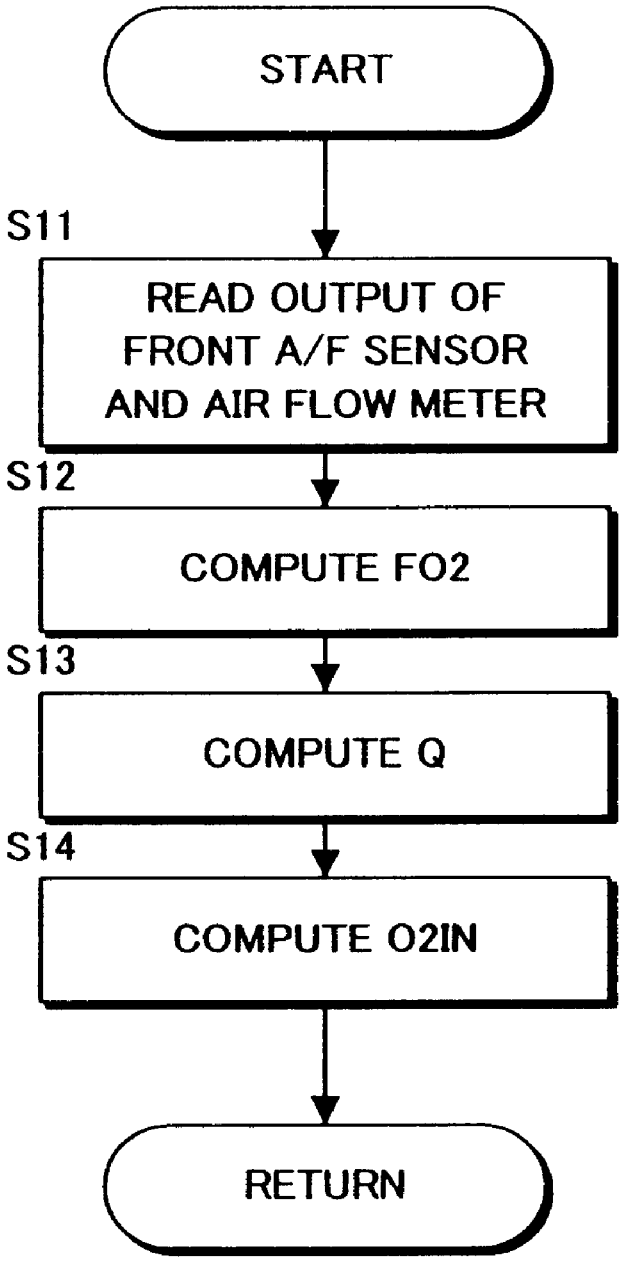
FIG. 6 is a flowchart showing a subroutine for computing an oxygen excess/deficiency amount in the exhaust flowing into the catalyst.
Figure 7:
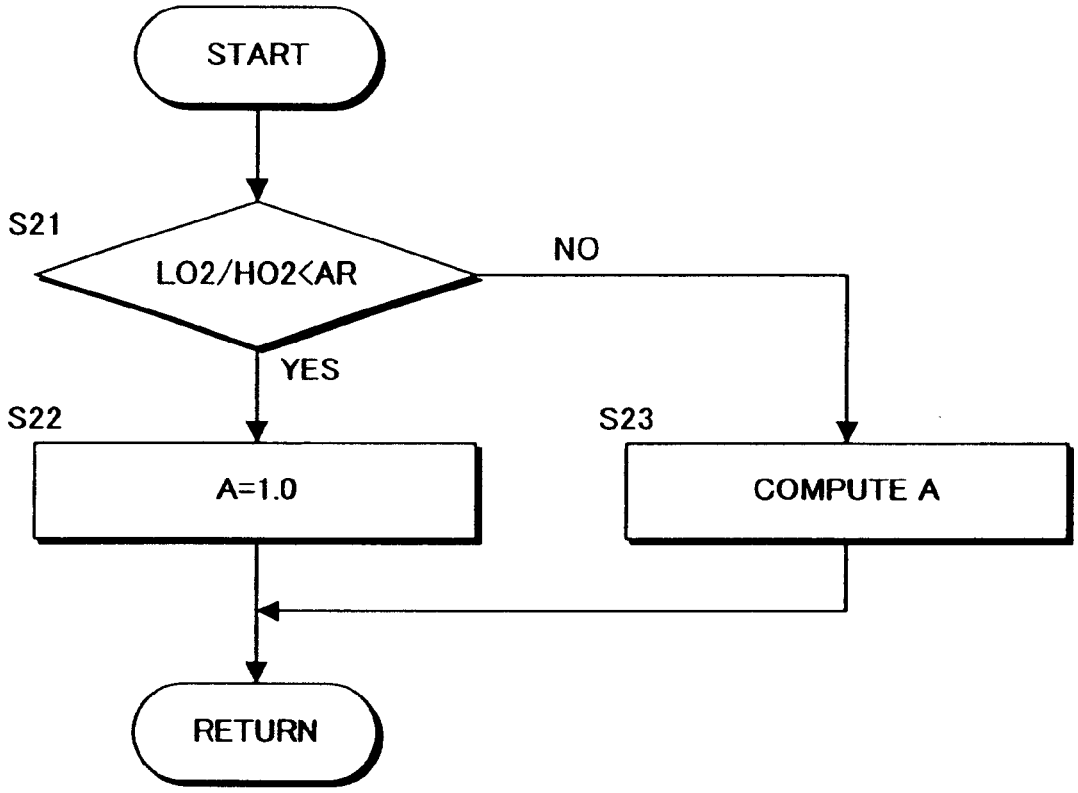
FIG. 7 is a flowchart showing a subroutine for computing an oxygen release rate of a high speed component.

In the step S5, a subroutine for computing an oxygen excess/insufficiency amount O2IN shown in FIG. 6 is performed, and the oxygen excess/insufficiency amount O2IN of the exhaust flowing into the catalyst 3 is computed. In a step S6, a subroutine for computing a release rate A of oxygen from the high speed component of the oxygen storage amount shown in FIG. 7 is performed, and the release rate A of oxygen from the high speed component is thereby computed.

Figure 8:
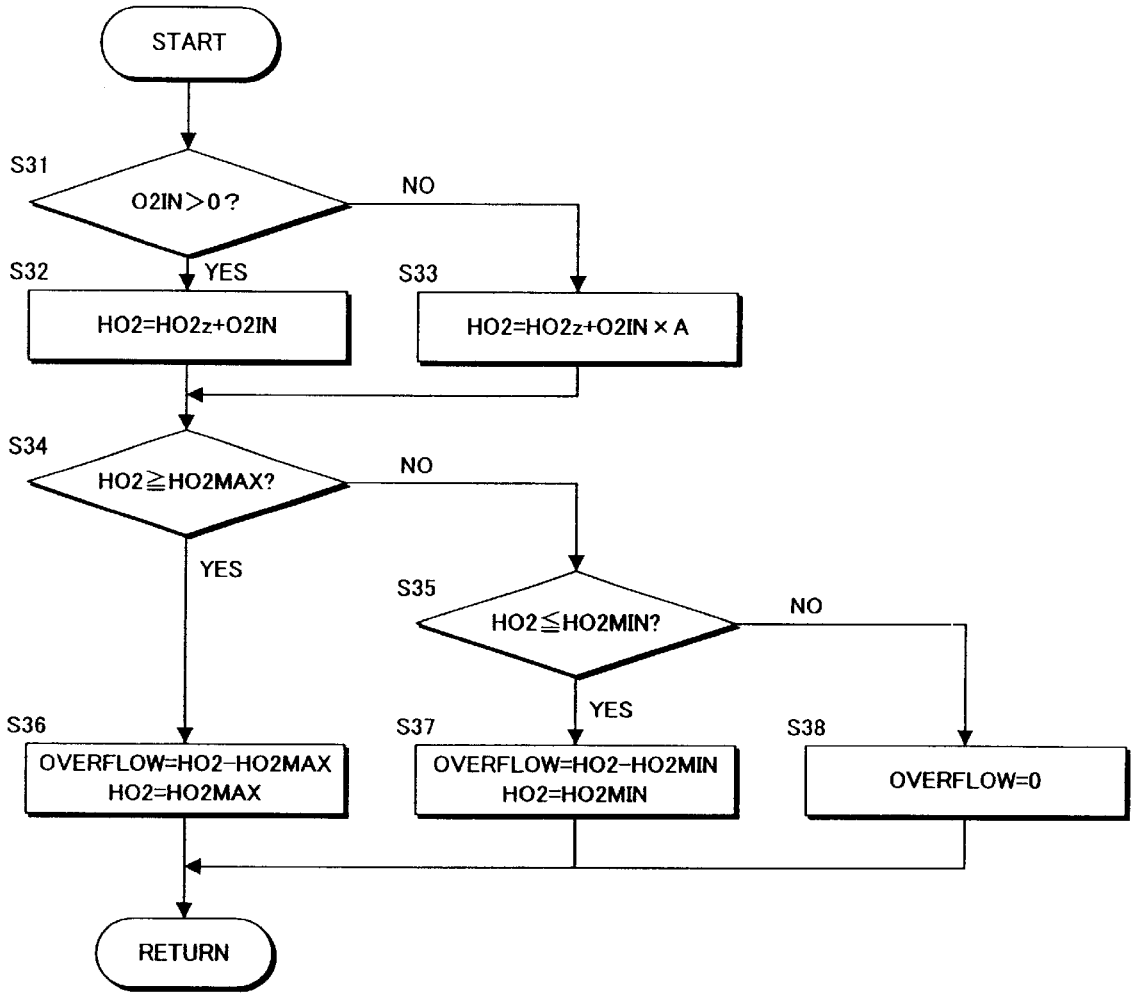
FIG. 8 is a flowchart showing a subroutine for computing the high speed component of the oxygen storage amount.

In the step S7, a subroutine for computing the high speed component HO2 of the oxygen storage amount shown in FIG. 8 is performed, wherein the high speed component HO2 and an overflow oxygen amount OVERFLOW which is the oxygen amount not stored as the high speed component HO2, are computed based on the oxygen excess/deficiency amount O2IN and oxygen release rate A. As the initial value of the high speed component HO2, the initial value HO2INT computed by the routine shown in FIG. 3 is used.

Figure 9:
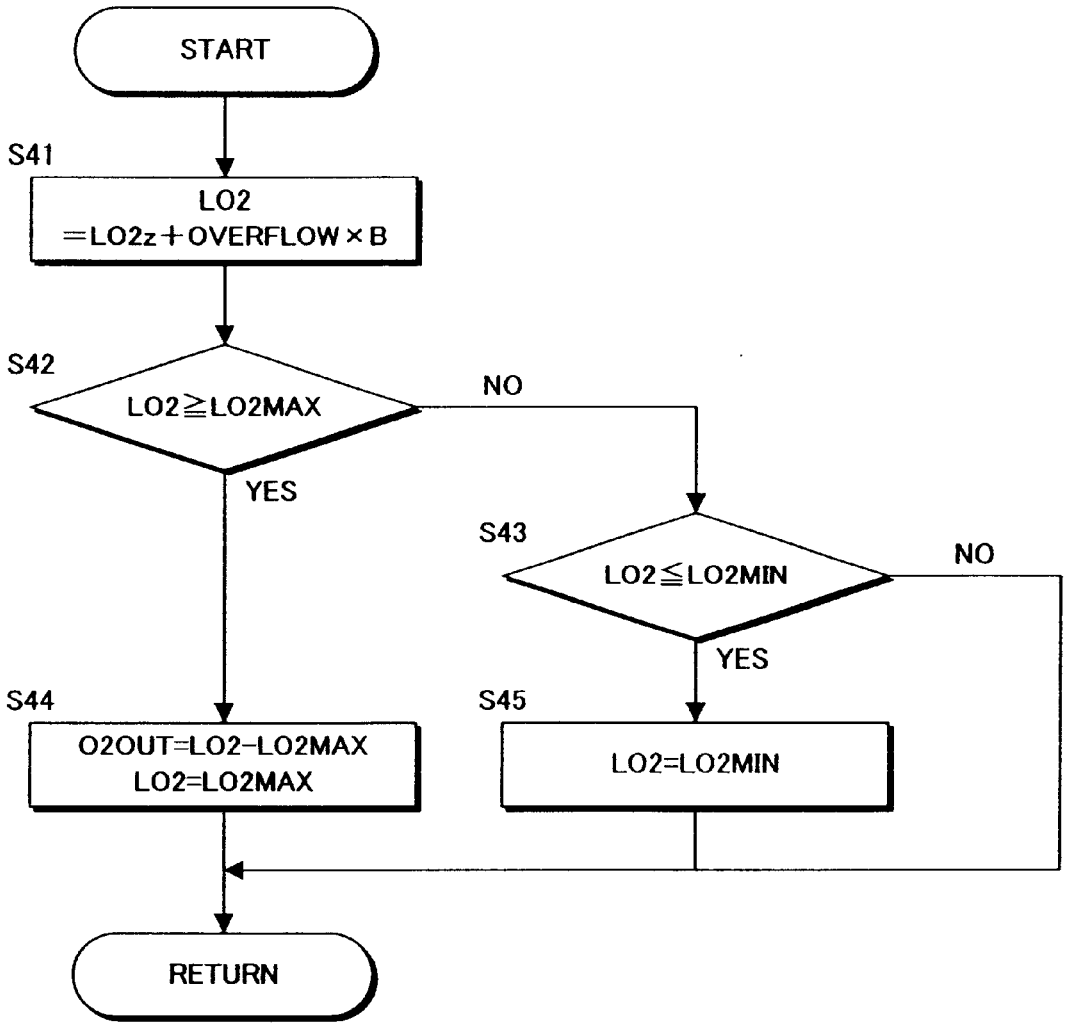
FIG. 9 is a flowchart showing a subroutine for computing a low speed component of the oxygen storage amount.

In a step S8, it is determined whether not the oxygen excess/insufficiency amount O2IN in the exhaust flowing into the catalyst 3 was all stored as the high speed component HO2, based on the overflow oxygen amount OVERFLOW. When the oxygen excess/deficiency amount O2IN was completely stored as the high speed component (OVERFLOW=0), the routine is terminated, otherwise the routine proceeds to a step S9, and a subroutine for computing the low speed component LO2 shown in FIG. 9 is performed.

In the step S9, the low speed component LO2 is computed based on the overflow oxygen amount OVERFLOW. An initial value LO2INT of the low speed component is set to a maximum capacity LO2MAX.

In the processing shown in FIG. 5, when the catalyst temperature TCAT is lower than the activation temperature TACTo in the step S4, the oxygen storage amount is not computed. However, the step S4 may be eliminated, and the effect of the catalyst temperature TCAT may be reflected in the oxygen release rate A of the high speed component or an oxygen storage/release rate B of the low speed component described later.

Next, a subroutine performed from steps S5 to S7 and in the step S9 will be described.

FIG. 6 shows the subroutine for computing the oxygen excess/deficiency amount O2IN of the exhaust flowing into the catalyst 3. In this subroutine, the oxygen excess/deficiency amount O2IN of the exhaust flowing into the catalyst 3 is computed based on the air-fuel ratio of the exhaust upstream of the catalyst 3 and the intake air amount of the engine 1.

First, in a step S11, the output of the front A/F sensor 4 and the output of the air flow meter sensor 9 are read.

Next, in a step S12, the output of the front A/F sensor 4 is converted to an excess/deficiency oxygen concentration FO2 of the exhaust flowing into the catalyst 3 using a predetermined conversion table. Here, the excess/deficiency oxygen concentration FO2 is a relative concentration based on the oxygen concentration at the stoichiometric air-fuel ratio. If the exhaust air-fuel ratio is equal to the stoichiometric air-fuel ratio, it is zero, if it is richer than the stoichiometric air-fuel ratio it is negative, and if it is leaner than the stoichiometric air-fuel ratio, it is positive.

In a step S13, the output of the air flow meter sensor 9 is converted to an intake air amount Q using a predetermined conversion table, and in a step S14, the intake air amount Q is multiplied by the excess/deficiency oxygen concentration FO2 to compute the excess/deficiency oxygen amount O2IN of the exhaust flowing into the catalyst 3.

As the excess/deficiency oxygen concentration FO2 has the above characteristics, the excess/deficiency oxygen amount O2IN is zero when the exhaust flowing into the catalyst 3 is at the stoichiometric air-fuel ratio, a negative value when it is rich, and a positive value when it is lean.

FIG. 7 shows a subroutine for computing the oxygen release rate A of the high speed component of the oxygen storage amount. In this subroutine, as the oxygen release rate of the high speed component HO2 is affected by the low speed component LO2, the oxygen release rate A of the high speed component is computed according to the low speed component LO2.

First, in a step S21, it is determined whether or not a ratio LO2/HO2 of low speed component relative to the high speed component is less than a predetermined value AR (e.g. AR=10). When it is determined that the ratio LO2/HO2 is less than the predetermined value AR, i.e., when the high speed component HO2 is relatively larger than the low speed component LO2, the routine proceeds to a step S22, and the oxygen release rate A of the high speed component is set to 1.0 expressing the fact that oxygen is released first from the high speed component HO2.

On the other hand, when it is determined that the ratio LO2/HO2 is not less than the predetermined value AR, oxygen is released from the high speed component HO2 and the low speed component LO2 so that the ratio of the low speed component LO2 to the high speed component HO2 does not vary. The routine then proceeds to a step S23, and a value of the oxygen release rate A of the high speed component is computed which does not cause the ratio LO2/HO2 to vary.

FIG. 8 shows a subroutine for computing the high speed component HO2 of the oxygen storage amount In this subroutine, the high speed component HO2 is computed based on the oxygen excess/deficiency amount O2IN of the exhaust flowing into the catalyst 3 and the oxygen release rate A of the high speed component.

First, it is determined in a step S31 whether or not the high speed component HO2 is being stored or released based on the oxygen excess/deficiency amount O2IN.

When the air-fuel ratio of the exhaust flowing into the catalyst 3 is lean and the oxygen excess/deficiency amount O2IN is larger than zero, it is determined that the high speed component HO2 is being stored, the routine proceeds to a step S32, and the high speed component HO2 is computed from the following equation (1):

$$HO2=HO2z+O2IN \quad (1)$$

where:

HO2z=value of high speed component HO2 on immediately preceding occasion.

On the other hand, when it is determined that the oxygen excess/deficiency amount O2IN is less than zero and the high speed component is being released, the routine proceeds to a step S33, and the high speed component HO2 is computed from the following equation (2):

$$HO2=HO2z+O2IN\times A \quad (2)$$

where:

A=oxygen release rate of high speed component HO2.

In steps S34, S35, it is determined whether or not the computed HO2 exceeds the maximum capacity HO2MAX of the high speed component, or whether it is not less than a minimum capacity HO2MIN (=0).

When the high speed component HO2 is greater than the maximum capacity HO2MAX, the routine proceeds to a step S36, the overflow oxygen amount (excess amount) OVERFLOW flowing out without being stored as the high speed component HO2 is computed from the following equation (3):

$$\text{OVERFLOW}=HO2-HO2\text{MAX} \quad (3),$$

and the high speed component HO2 is limited to the maximum capacity HO2MAX.

When the high speed component HO2 is less than the minimum capacity HO2MIN, the routine proceeds to a step S37, the overflow oxygen amount (deficiency amount) OVERFLOW which was not stored as the high speed component HO2 is computed by the following equation (4):

$$\text{OVERFLOW}=HO2-HO2\text{MIN} \quad (4),$$

and the high speed component HO2 is limited to the minimum capacity HO2MIN. Here, zero is given as the minimum capacity HO2MIN, so the oxygen amount which is deficient when all the high speed component HO2 has been released is computed as a negative overflow oxygen amount.

When the high speed component HO2 lies between the maximum capacity HO2MAX and minimum capacity HO2MIN, the oxygen excess/deficiency amount O2IN of the exhaust flowing into the catalyst 3 is all stored as the high speed component HO2, and zero is set to the overflow oxygen amount OVERFLOW in step S38.

Here, when the high speed component HO2 is greater than the maximum capacity HO2MAX or less than the minimum capacity HO2MIN, the overflow oxygen amount OVERFLOW which has overflowed from the high speed component HO2 is stored as the low speed component LO2.

FIG. 9 shows a subroutine for computing the low speed component LO2 of the oxygen storage amount. In this subroutine, the low speed component LO2 is computed based on the overflow oxygen amount OVERFLOW which has overflowed from the high speed component HO2.

According to this, in a step S41, the low speed component LO2 is computed by the following equation (5):

$$LO2=LO2z+\text{OVERFLOW}\times B \quad (5)$$

where:

LO2z=immediately preceding value of low speed component LO2, and

B=oxygen storage/release rate of low speed component.

Here, the oxygen storage/release rate B of the low speed component is set to a positive value less than 1, but actually has different characteristics for storage and release. Further, the real storage/release rate is affected by the catalyst temperature TCAT and the low speed component LO2, so the storage rate and release rate can be set to vary independently. In this case, when the overflow oxygen amount OVERFLOW is positive, oxygen is in excess, and the oxygen storage rate at this time is set to for example a value which is larger the higher the catalyst temperature TCAT or the smaller the low speed component LO2. Also, when the overflow oxygen amount OVERFLOW is negative, oxygen is deficient, and the oxygen release rate at this time may for example be set to a value which is larger the higher the catalyst temperature TCAT or the larger the low speed component LO2.

In steps S42, S43, in the same way as when the high speed component HO2 is computed, it is determined whether or not the computed low speed component LO2 has exceeded a maxi maximum capacity LO2MAX or is less than a minimum capacity LO2MIN (=0).

When maximum capacity LO2MAX is exceeded, the routine proceeds to a step S44, an oxygen excess/deficiency amount O2OUT which has overflowed from the low speed component LO2 is computed from the following equation (6):

$$LO2\text{OUT}=LO2-LO2\text{MAX} \quad (6)$$

and the low speed component LO2 is limited to the maximum capacity LO2MAX. The oxygen excess/deficiency amount O2OUT flows out downstream of the catalyst 3.

When the low speed component LO2 is less than the minimum capacity, the routine proceeds to a step S45, and the low speed component LO2 is limited to the minimum capacity LO2MIN.

Next, the resetting of the computed value of the oxygen storage amount performed by the controller 6 will be described. By resetting the computed value of the oxygen storage amount under predetermined conditions, computational errors which have accumulated so far are eliminated, and the computational precision of the oxygen storage amount can be improved.

Figure 10:
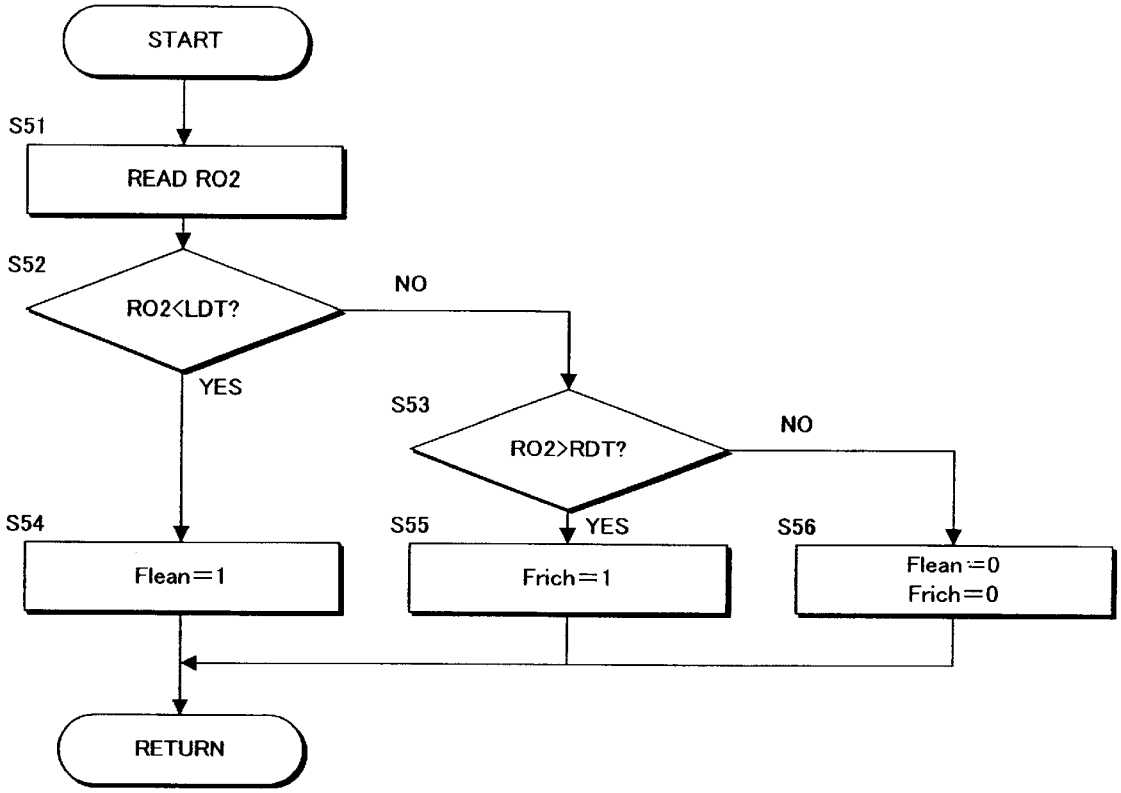
FIG. 10 is a flowchart showing a routine for determining a reset condition.

FIG. 10 shows the details of a routine for determining the reset condition. This routine determines whether or not a condition for resetting the oxygen storage amount (high speed component HO2 and low speed component LO2) holds from the exhaust air-fuel ratio downstream of the catalyst 3, and sets a flag Frich and a flag Flean.

First, in a step S51, the output of the rear oxygen sensor 5 which detects the exhaust air-fuel ratio downstream of the catalyst 3 is read. Subsequently, in a step S52, the rear oxygen sensor output RO2 is compared with a lean determining threshold LDT, and in a step S53, the rear oxygen sensor output RO2 is compared with a rich determining threshold RDT.

As a result of these comparisons, when the rear oxygen sensor output RO2 is less than the lean determining threshold LDT, the routine proceeds to a step S54, and the flag Flean is set to "1" showing that the lean reset condition for the oxygen storage amount holds. When the rear oxygen sensor output RO2 exceeds the rich determining threshold RDT, the routine proceeds to a step S55, and the flag Frich is set to "1" showing that the rich reset condition for the oxygen storage amount holds.

When the rear oxygen sensor output RO2 lies between the lean determining threshold LDT and rich determining threshold RDT, the routine proceeds to a step S56, and the flags Flean and Frich are set to "0" showing that the lean reset condition and rich reset condition do not hold.

Figure 11:
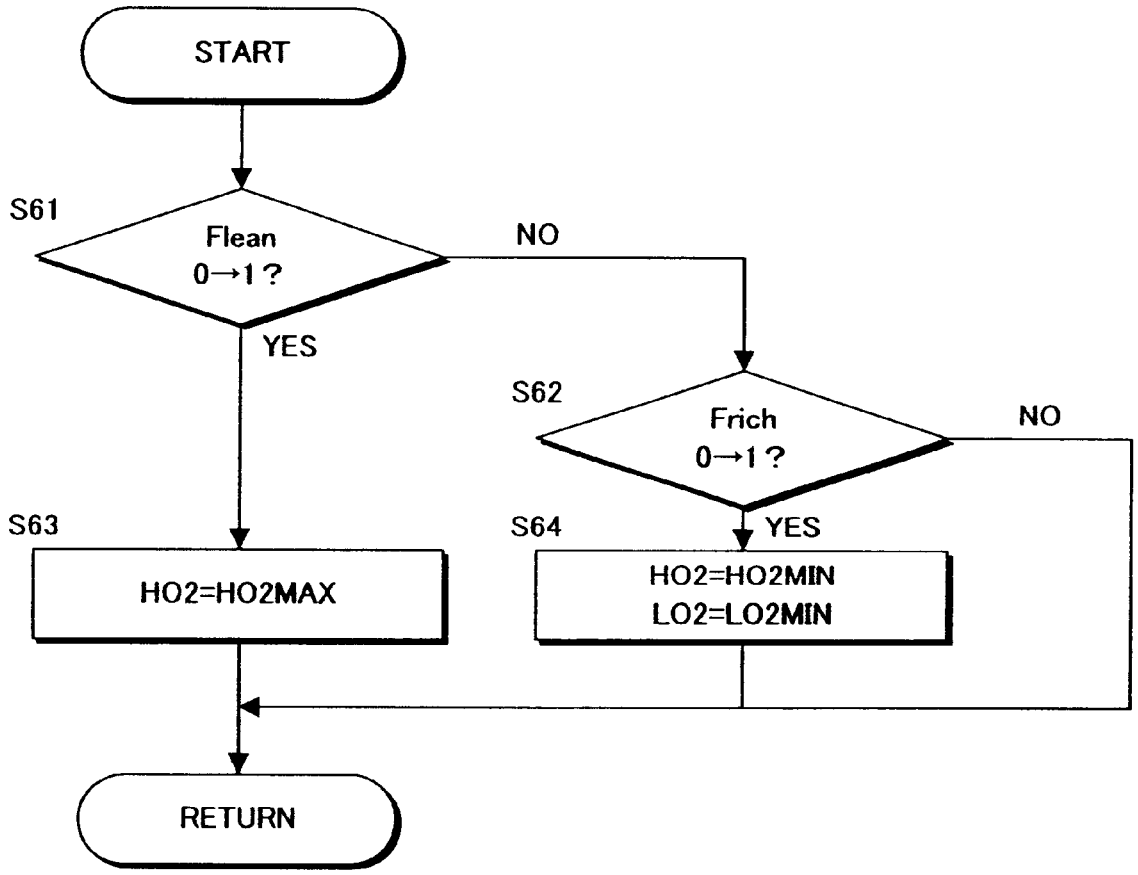
FIG. 11 is a flowchart showing a routine for performing reset of the computed oxygen storage amount.

FIG. 11 shows a routine for resetting the oxygen storage amount.

According to this, in steps S61, S62, it is determined whether or not the lean reset conditions or rich reset conditions hold based on the variation of the values of the flags Flean and Frich.

When the flag Flean changes from "0" to "1", and it is determined that lean reset conditions hold, the routine proceeds to a step S63, and the high speed component HO2 of the oxygen storage amount is reset to the maximum capacity HO2MAX. At this time, resetting of the low speed component LO2 is not performed. On the other hand, when the flag Frich changes from "0" to "1", and it is determined that rich reset conditions hold, the routine proceeds to a step S64, and the high speed component HO2 and low speed component LO2 of the oxygen storage amount are respectively reset to the minimum capacities HO2MIN, LO2MIN.

The reason why resetting is performed under these conditions is that as the oxygen storage rate of the low speed component LO2 is slow, oxygen overflows downstream of the catalyst even if the low speed component LO2 has not reached maximum capacity when the high speed component HO2 reaches maximum capacity, and when the exhaust air-fuel ratio downstream of the catalyst becomes lean, it may be considered that at least the high speed component HO2 has reached maximum capacity.

When the exhaust air fuel ratio downstream of the catalyst becomes rich, oxygen is not released from the low speed component LO2 which is released slowly. Therefore, it may be considered that the high speed component HO2 and low speed component LO2 are both not being stored and are at minimum capacity.

Next, the air-fuel ratio control performed by the controller 6 (oxygen storage amount constant control) will be described.

Figure 12:
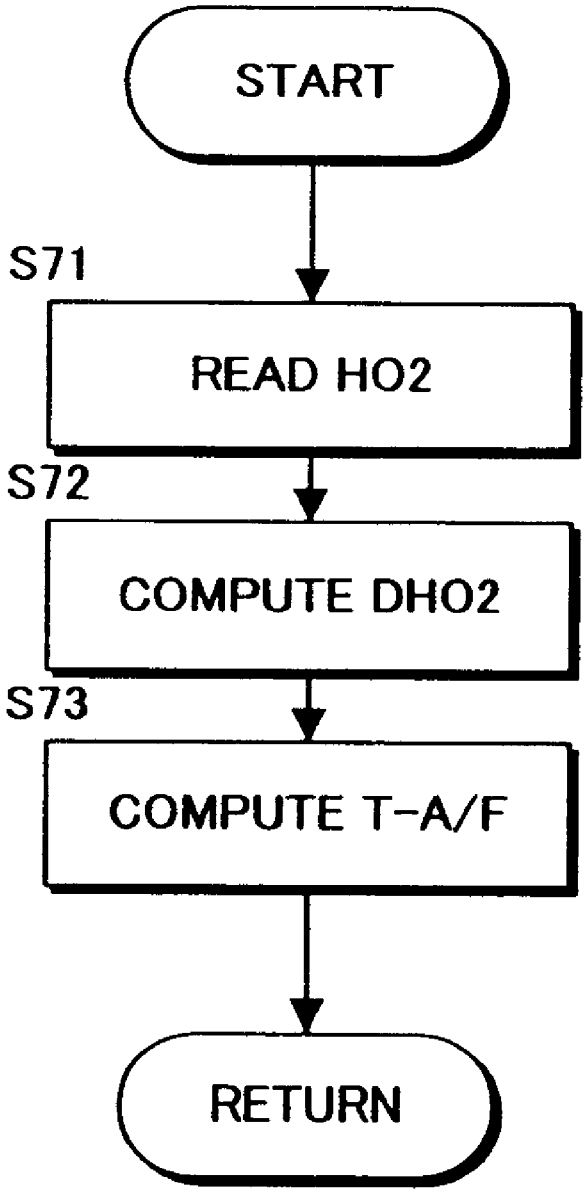
FIG. 12 is a flowchart showing a routine for computing a target air fuel ratio based on the oxygen storage amount.

FIG. 12 shows a routine for computing a target air fuel ratio based on the oxygen storage amount.

According to this, in a step S71, the high speed component HO2 of the present oxygen storage amount is read. In a step S72, a deviation DHO2 (=oxygen excess/deficiency amount required by catalyst 3) between the current high speed component HO2 and a target value TGHO2 of the high speed component, is computed. The target value TGHO2 of the high speed component is set to, for example, half of the maximum capacity HO2MAX of the high speed component.

In a step S73, the computed deviation DHO2 is converted to an air-fuel ratio equivalent value, and a target air-fuel ratio T-A/F of the engine 1 is set.

Therefore, according to this routine, when the high speed component HO2 of the oxygen storage amount does not reach a target amount, the target air fuel ratio of the engine 1 is set to lean, and the oxygen storage amount (high speed component HO2) is increased. On the other hand, when the high speed component HO2 exceeds the target amount, the target air fuel ratio of the engine 1 is set to rich, and the oxygen storage amount (high speed component HO2) is decreased.

Next, the overall action performed by the above control will be described.

In the exhaust purification device according to this invention, computation of the oxygen storage amount of the catalyst 3 begins when the engine 1 starts, and the air-fuel ratio of the engine 1 is controlled so that the oxygen storage amount of the catalyst 3 is constant so as to maintain the conversion efficiency of the catalyst 3 at a maximum.

The controller 6 computes the oxygen storage amount of the catalyst 3 based on the air-fuel ratio of the exhaust flowing into the catalyst 3 and the intake air amount of the engine 1. The computation of the oxygen storage amount is performed separately for the high speed component HO2 and low speed component LO2 in accordance with the actual characteristics.

Specifically, first, the initial value HO2INT of the high speed component HO2 of the oxygen storage amount is estimated by looking up a table shown in FIG. 4 based on the catalyst temperature TCATINT when the engine 1 starts detected by the catalyst temperature sensor 11.

The oxygen storage amount when the engine starts, particularly the high speed component HO2 of the oxygen storage amount, is effectively determined by the catalyst temperature when the engine starts, so by estimating the initial value of the oxygen storage amount based on the catalyst temperature TACTINT when the engine starts in this way, the computational precision of the oxygen storage amount immediately after engine startup is improved, and the conversion efficiency of the catalyst 3 can be maintained at a high level even immediately after startup.

Further, after the engine stops, air diffuses from the outlet of the exhaust passage, and the low speed component of the oxygen storage amount is a maximum capacity. Therefore, the initial value of the low speed component is set to its maximum capacity LO2MAX. In this way, computational precision for the low speed component is also enhanced, the computation is performed in accordance with actual characteristics immediately after startup for both the high speed component and low speed component, and the conversion efficiency of the catalyst 3 can be maintained at a still higher level.

After the engine 1 stops, when the engine restarts immediately, diffusion of air from the outlet of the exhaust passage does not proceed and the low speed component does not reach the maximum capacity, but even in this case, the low speed component is reset to the maximum capacity LO2MAX. In other words, the computation value of the low speed component LO2 immediately after startup contains an error. However, even in this case, the computation value is reset to the minimum capacity (FIG. 11) when the exhaust flowing out from the catalyst 3 has become rich, so computational errors in the low speed component are all eliminated.

Subsequently, the high speed component HO2 and low speed component LO2 are computed using the estimated initial value HO2INT of the high speed component and initial value LO2INT of the low speed component (=LO2MAX). On the first occasion that the routines are performed, in the computation of the release rate of the high speed component (FIG. 7), the computation assumes the LO2/HO2 is LO2MAX/HO2INT, and in the computation of the high speed component (FIG. 8), the computation assumes that HO2z is HO2INT.

When oxygen is stored, the oxygen is preferentially stored as the high speed component HO2, and once it can no longer be stored as the high speed component HO2, the computation is performed assuming that it is stored as the low speed component LO2. Further, when oxygen is released, when the ratio (LO/HO2) of the low speed component LO2 and high speed component HO2 is less than the predetermined value AR, oxygen is released preferentially from the high speed component HO2, and once the ratio LO2/HO2 has become the predetermined value AR, the computation is performed assuming that oxygen is released from both the low speed component LO2 and high speed component HO2 to maintain the ratio LO2/HO2.

When the high speed component HO2 of the computed oxygen storage amount is larger than the target value, the controller 6 decreases the high speed component by controlling the air-fuel ratio of the engine 1 to rich, and when it is less than the target value, the high speed component HO2 is increased by controlling the air-fuel ratio to lean.

As a result, the high speed component HO2 of the oxygen storage amount is maintained at the target value, and even if the air-fuel ratio of the exhaust flowing into the catalyst 3 shifts from the stoichiometric air-fuel ratio, oxygen is immediately stored as the high speed component HO2 or immediately released as the high speed component HO2 which has a high responsiveness, the catalyst atmosphere is corrected to the stoichiometric air-fuel ratio, and the conversion efficiency of the catalyst 3 is maintained at a maximum.

Further, if computational errors accumulate, the computed oxygen storage amount shifts from the real oxygen storage amount, however the oxygen storage amount (high speed component HO2 and low speed component LO2) is reset with a timing at which the exhaust downstream of the catalyst 3 becomes rich or lean, and any discrepancy between the computed value and real oxygen storage amount is corrected.

Figure 13:
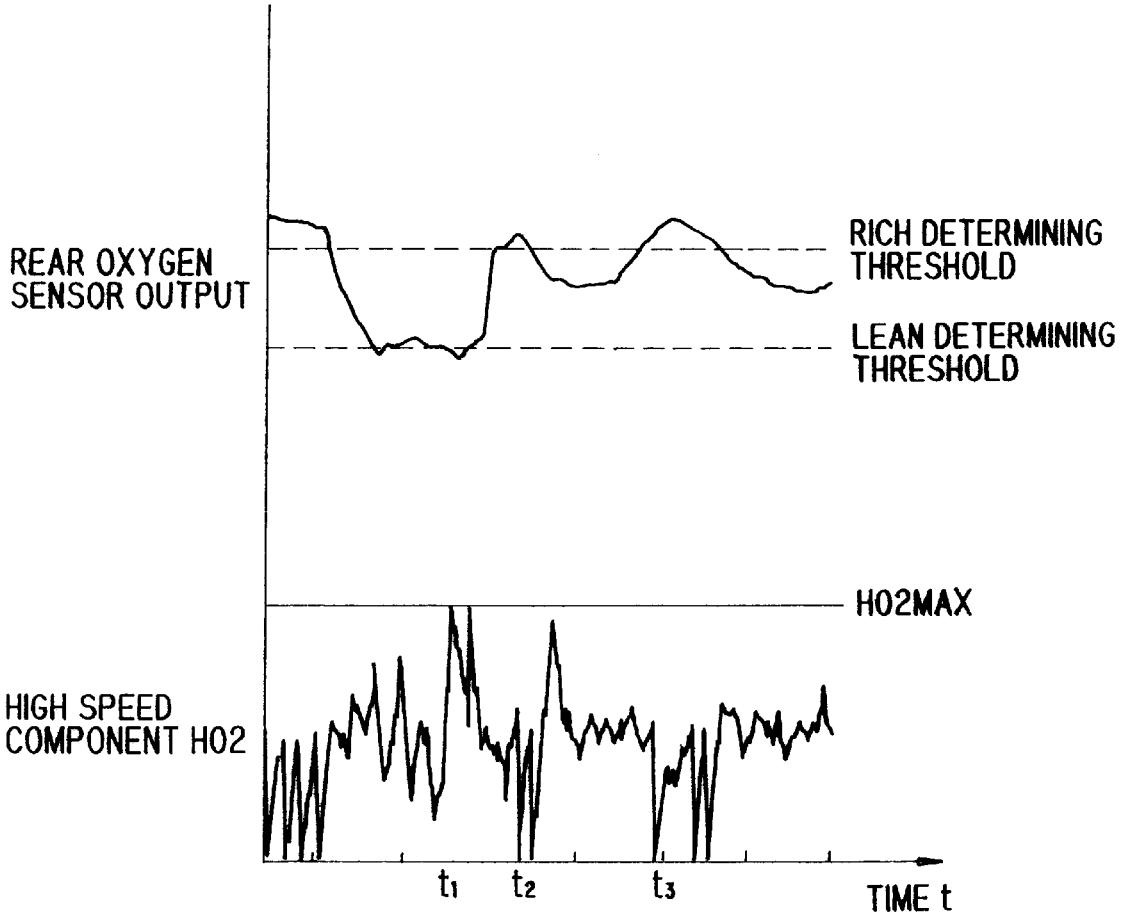
FIG. 13 is a diagram showing how a rear oxygen sensor output and high speed component vary when the oxygen storage amount is controlled to be constant.

FIG. 13 shows how the high speed component HO2 varies when the above oxygen storage amount constant control is performed.

In this case, at the time t1, the output of the rear oxygen sensor 5 becomes less than the lean determining threshold and lean reset conditions hold, so the high speed component HO2 is reset to the maximum capacity HO2MAX. However, the low speed component LO2 is not necessarily a maximum at this time, so reset of the low speed component is not performed, not shown.

At times t2, t3, the output of the rear oxygen sensor 5 becomes greater than the rich determining threshold and rich reset conditions hold, so the high speed component HO2 of the oxygen storage amount is reset to the minimum capacity (=0). The low speed component LO2 at this time is also reset to the minimum capacity, not shown.

Thus, resetting of the computed values of the oxygen storage amount is performed with a timing at which the air-fuel ratio of the exhaust downstream of the catalyst 3 becomes rich or lean, and as a result of the discrepancy from the real oxygen storage amount being corrected, the computational precision of the oxygen storage amount of the catalyst is further enhanced, the precision of air-fuel ratio control for maintaining the oxygen storage amount constant is increased, and the conversion efficiency of the catalyst is maintained at a high level.

Next, a second embodiment will be described.

Figure 14:
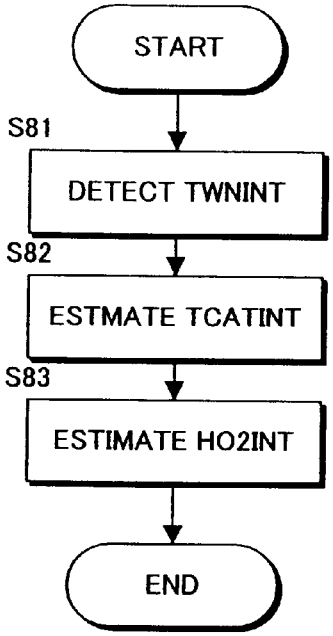
FIG. 14 is a flowchart showing a second embodiment of the invention.

According to this embodiment, the method of estimating the initial value HO2INT of the high speed component of the oxygen storage amount is different from that of the preceding embodiment. The initial value HO2INT of the high speed component is estimated by a routine shown in FIG. 14.

Figure 15:
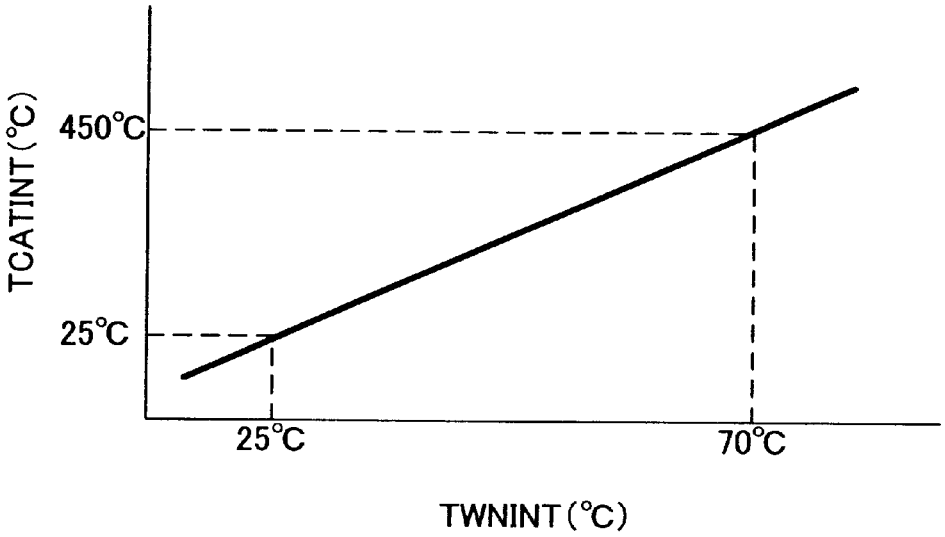
FIG. 15 is a table used for estimating the catalyst temperature from the cooling water temperature on engine startup.

According to this, first, a cooling water temperature TWNINT on startup of the engine 1 is detected based on the output of the cooling water temperature sensor 10 in a step S81. In a step S82, the catalyst temperature TCATINT on startup of the engine 1 is estimated by looking up a table shown in FIG. 15, based on this detected cooling water temperature TWNINT on engine startup. When the time from when the engine 1 had stopped on the immediately preceding occasion to when the engine 1 is restarted is short, the cooling water temperature TWNINT on startup of the engine 1 is high, and as it may be considered that the catalyst 3 is still hot, the catalyst temperature TCATINT is set high.

In a step S83, the initial value TCATINT of the high speed component is estimated by looking up a table shown in FIG. 4 based on the estimated catalyst temperature TCATINT.

Therefore, according also to this embodiment, the computation of the oxygen storage amount is performed based on the estimated initial value, so the computational precision of the oxygen storage amount immediately after startup of the engine 1 improves. Further, there is no need to directly detect the catalyst temperature with the catalyst temperature sensor to estimate the initial value HO2INT of the high speed component, so the catalyst temperature sensor is unnecessary. However, if the catalyst temperature sensor is removed, it is then necessary to estimate the catalyst temperature in the step S3 of FIG. 5. In this case, the catalyst temperature may for example be estimated from the cooling water temperature, engine load and engine rotation speed.

Herein, the catalyst temperature TCATINT of the catalyst 3 on startup of the engine 1 was estimated based on the cooling water temperature of the engine 1 on startup of the engine 1, but the temperature TCATINT of the catalyst 3 may also be estimated based on the oil temperature of the engine 1 on startup of the engine 1.

A third embodiment will now be described.

According also to this embodiment, the method of estimating the initial value HO2INT of the high speed component of the oxygen storage amount is different. The initial value HO2INT of the high speed component is estimated by a routine shown in FIG. 16.

According to this, first, in a step S91, the cooling water temperature TWNINT of the engine 1 on engine startup is detected based on the output of the cooling water sensor 10. In a step S92, a cooling water temperature TWNs of the engine 1 and temperature TCATS of the catalyst 3 on the immediately preceding occasion the engine 1 stopped, are read. The cooling water temperature TWNs of the engine 1 and temperature TCATs of the catalyst 3 on the immediately preceding occasion the engine 1 stopped, are stored in the memory of the controller 6 on the immediately preceding occasion the engine 1 stopped.

Figure 16:
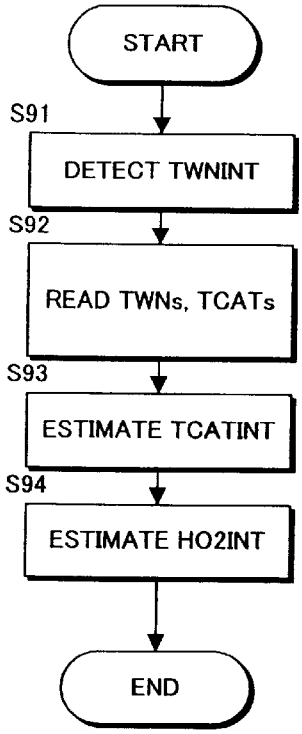
FIG. 16 is a flowchart showing a third embodiment of this invention.
Figure 17:
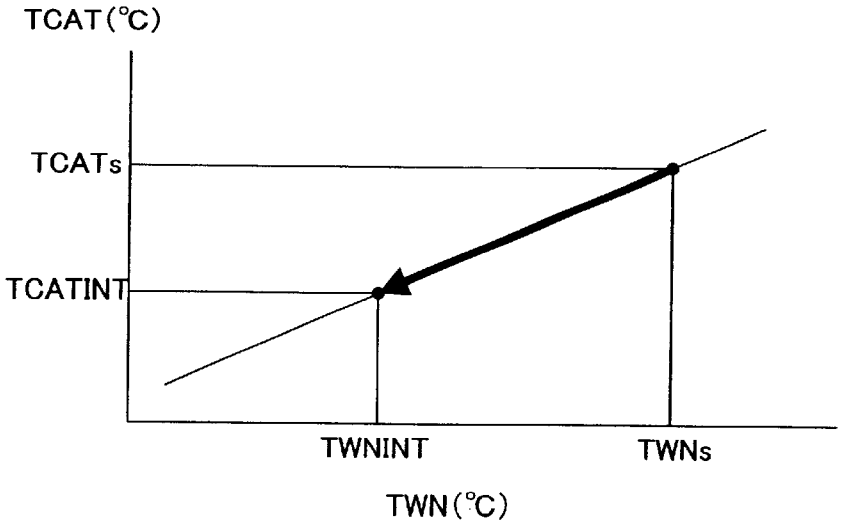
FIG. 17 is a diagram for describing the estimation of the catalyst temperature on engine startup.

The temperature TCATINT of the catalyst 3 on engine startup is estimated by the following equation (7):

$$TCATINT=TCATs-k^{x}(TWNs-TWNINT) \quad (7)$$

where:

k=a predetermined coefficient using these values in the step S93 (FIG. 16). For example, when the catalyst temperature TCATs and cooling water temperature TWNs on the immediately preceding occasion the engine 1 stopped are respectively 450° C. and 70°C., the time from when the engine 1 stopped to when the engine 1 is restarted is short, and the cooling water temperature of the engine 1 is also 70° C., from equation (7), we have:

$$TCATINT=450-k\times(70-70)=450^{\circ}\ C.$$

When the catalyst temperature TCATs and cooling water temperature TWNs on the immediately preceding occasion the engine 1 stopped are respectively 450° C. and 70° C., the time from when the engine 1 stopped to when the engine 1 is restarted is long (e.g., when it is left overnight), and the cooling water temperature of the engine 1 is equal to the outside temperature, i.e., 25° C., from equation (7), we have:

$$TCATINT=450-k\times(70-25)=\text{approx. } 25^{\circ}\ C.$$

where:

k=9.45.

Hence, once the temperature TCATINT of the catalyst 3 on engine startup is estimated, the initial value HO2INT of the high speed component is estimated by looking up the table shown in FIG. 4 (step S94).

Therefore, according also to this embodiment, the oxygen storage amount is computed based on the estimated initial value, the computational precision of the oxygen storage amount immediately after engine startup is enhanced, and as the catalyst temperature TCATINT on engine startup is estimated, the catalyst temperature sensor is unnecessary. However, in this case also, the catalyst temperature must be estimated in the step S3 of FIG. 4 as in the case of the second embodiment.

Herein, the catalyst temperature TCATINT on engine startup was estimated based on the drop in the cooling water temperature of the engine 1, but it may also be estimated based on the drop in the oil temperature of the engine 1.

The entire contents of Japanese Patent Applications P2000-39980 (filed Feb. 17, 2000) and 2001-36287(filed Feb. 14, 2001) are incorporated herein by reference.

Although the invention has been described above by reference to a certain embodiment of the invention, the invention is not limited to the embodiment described above. Modifications and variations of the embodiments described above will occur to those skilled in the art, in light of the above teachings. The scope of the invention is defined with reference to the following claims.

What is claimed is:

1. An exhaust purification device for an engine, comprising:

a catalyst provided in an exhaust passage of the engine;

a sensor which detects the characteristics of the exhaust flowing into the catalyst, a sensor which detects the temperature of a cooling fluid of the engine, and a microprocessor programmed to:

store the temperature of the cooling fluid of the engine and temperature of the catalyst when the engine stops, estimate the temperature of the catalyst on engine startup based on the temperature of the cooling fluid of the engine on engine startup, and the temperature of the cooling fluid of the engine and the temperature of the catalyst on the immediately preceding occasion when the engine stopped, estimate an oxygen storage amount of the catalyst on engine startup based on the estimated temperature of the catalyst on engine startup, compute the oxygen storage amount of the catalyst based on the detected exhaust characteristics, using the oxygen storage amount on engine startup as an initial value, and control the air fuel ratio of the engine based on the computed oxygen storage amount so that the oxygen storage amount of the catalyst is a target value.

2. An exhaust purification device for an engine, comprising:

a catalyst provided in an exhaust passage of the engine;

a sensor which detects the characteristics of the exhaust flowing into the catalyst, and a microprocessor programmed to:

estimate an oxygen storage amount of the catalyst on engine startup based on the temperature of the catalyst on engine startup, compute the oxygen storage amount of the catalyst based on the detected exhaust characteristics, using the oxygen storage amount on engine startup as an initial value, and control the air fuel ratio of the engine based on the computed oxygen storage amount so that the oxygen storage amount of the catalyst is a target value, wherein the microprocessor is further programmed to compute the oxygen storage amount of the catalyst separately for a high speed component which has a high storage/release rate, and a low speed component which has a slower storage/release rate than the high speed component.

3. An exhaust purification device as defined in claim 2, wherein the microprocessor is further programmed to estimate the initial value of the high speed component based on the temperature of the catalyst on engine startup.

4. An exhaust purification device as defined in claim 2, wherein the microprocessor is further programmed to estimate the initial value of the high speed component based on the temperature of the catalyst and reset the computed value of the low speed component to a maximum capacity when the engine starts.

5. An exhaust purification device as defined in claim 2, further comprising a sensor which detects the characteristics of the exhaust flowing out from the catalyst, and the microprocessor is further programmed to reset the computed values of the high speed component and low speed component to their minimum capacities when the exhaust flowing out from the catalyst has become rich.

6. An exhaust purification device as defined in claim 2, further comprising a sensor which detects the characteristics of the exhaust flowing out from the catalyst, and the microprocessor is further programmed to reset the computed value of the high speed component to its maximum capacity when the exhaust flowing out from the catalyst has become lean.

* * * * *